United States Patent [19]

Strom

[11] 3,934,499

[45] Jan. 27, 1976

[54] SCRAP SHREDDING SYSTEM

[75] Inventor: Sven B. Strom, St. Louis, Mo.

[73] Assignee: American Pulverizer Company, St. Louis, Mo.

[22] Filed: Mar. 21, 1974

[21] Appl. No.: 453,410

[52] U.S. Cl. ..... 100/53; 100/DIG. 1; 100/95; 100/151; 241/186 R

[51] Int. Cl.[2] ..... B30B 9/32

[58] Field of Search ..... 100/DIG. 1, 95, 151, 152, 100/94, 144, 53; 241/186 R, 186.2, 186.4

[56] References Cited

UNITED STATES PATENTS

| | | | |
|---|---|---|---|
| 3,202,369 | 8/1965 | Judd | 241/190 |
| 3,283,698 | 11/1966 | Williams | 100/95 |
| 3,545,690 | 12/1970 | Burian et al. | 241/186 |

*Primary Examiner*—Billy J. Wilhite

*Attorney, Agent, or Firm*—Gravely, Lieder & Woodruff

[57] ABSTRACT

A shredding system for reducing automobiles and other large pieces of metal scrap to fragments includes a feed chute for receiving the scrap and a shredder to which the chute directs scrap. A track feeder is located above the chute for both crushing the scrap and for controlling the speed at which it is introduced into the shredder. The vertical position of the track feeder is adjusted by a hydraulic system which enables the track feeder to float on the scrap and exert a predetermined yet variable force, to raise or lower under command, or to remain in a fixed position. The shredder has a cutter bar with four cutting edges so that when one is no longer effective the bar can be turned to place another cutting edge opposite the paths of the hammers in the shredder. Also, the cutter bar is adjustable toward and away from the hammer paths to maintain optimum spacing. In addition, the bar can be moved longitudinally so that grooves worn in it are moved out of alignment with the hammer paths. The hammers are retained on hammer shafts extended through noncircular holes in disks carried by the rotor shaft. The portions of the holes located farthest from the rotor shaft are reduced and the shaft fits snugly in these portions when the rotor revolves. The portions of the holes located closest to the rotor shaft are enlarged to permit easy withdrawal of the hammer shafts from the disks. The liners of the shredder housing are held in place by special bolt fasteners which do not shake loose under the heavy vibrations to which the shredder is subjected.

13 Claims, 16 Drawing Figures

SCRAP SHREDDING SYSTEM

BACKGROUND OF THE INVENTION

This invention relates in general to reducing machines and more particular to a shredding unit for shredding large pieces of metal scrap.

The steel from junk automobiles, applicances, and the like is valuable for making new steel, provided it is in an acceptable condition. Steel companies prefer shredded or reduced scrap which is substantially free from impurities such as other metals, elastomers and plastics. Heretofore, shredding devices have been developed for converting automobile bodies, frames, and large appliances into relatively small fragments, but these machines have required an excessive amount of maintenance and are difficult to repair. For example, seat covers, upholstery, plastics, undercoating and the like tends to pack in the clearance areas surrounding the hammershafts and make these shafts extremely difficult to withdraw which is necessary in order to replace the hammers. The problem is compounded by the fact that the shafts are sometimes bent or otherwise distorted. Also, the hammershafts are often used to hold the rotor together in the axial direction so that once removed, the fine fits of the initial assembly are lost and the rigidity of the rotor is impaired. Furthermore, it is desirable to have the cutter bar, over which the scrap is fed into the rotor, located an optimum distance from the paths described by the hammers, but as the hammers wear this distance changes, reducing the efficiency of the machine. In addition, once the cutting edge on the cutter bar is lost, the entire bar must be replaced. Moreover, the bolts which hold the liners in place shake loose and a bolt tightening schedule must be undertaken usually once a day.

SUMMARY OF THE INVENTION

One of the principal objects of the present invention is to provide a shredding unit or system for automobiles and other large pieces of metal scrap which requires a minimum amount of maintenance and is substantially trouble free. Another object is to provide a shredding unit which is serviced easily and with a minimum amount of personnel. A further object is to provide a shredding unit which compresses the scrap to an optimum height before it is shredded into fragments. An additional object is to provide a shredding unit which can withstand substantial vibrations without having the bolts therein shake loose. These and other objects and advantages will become apparent hereinafter.

DESCRIPTION OF THE DRAWINGS

In the accompanying drawings which form part of the specification and wherein like numerals and letters refer to like parts whenever they occur.

DETAILED DESCRIPTION

Figure 1:
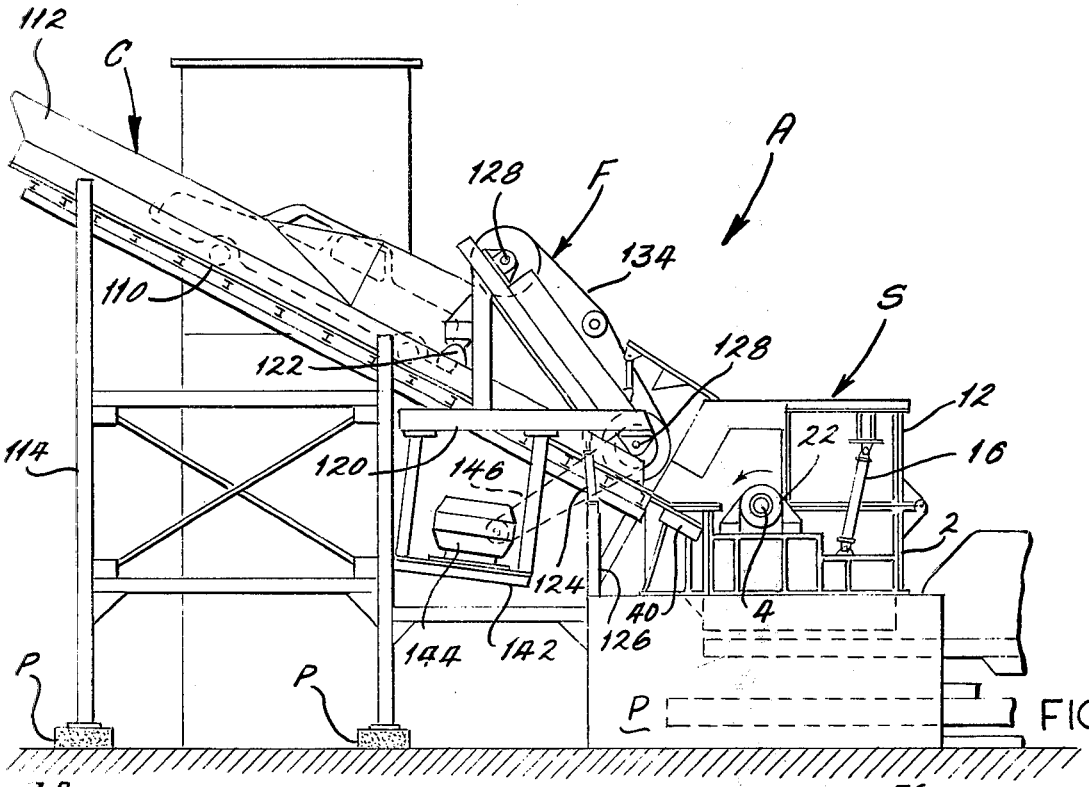
FIG. 1 is an elevational view of a shredding system for reducing large metal objects such as automobiles.

Referring now to the drawings (FIG. 1), A designates shredding unit or system primarily for reducing automobiles, appliances, and other large objects fabricated from steel to relatively small metal fragments which are suitable for use in current steel making processes. Basically, the shredding unit A comprises a shredder S, a feed chute C for directing scrap automobiles and the like into the shredder S, and a track feeder F for crushing the scrap and for controlling the speed at which it is introduced into the shredder S. The foregoing basic components are supported on a poured concrete foundation P.

The Shredder

The shredder S (FIGS. 2-9) includes a housing 2 and a rotor 4 which revolves in the housing 2. The housing 2 rests on the foundation P and has sidewalls 6 and end walls 8 and 10, as well as an open bottom through which reduced or fragmentized scrap is discharged from the shredder S. One end of the housing 2 is closed by a cover assembly of 12 (FIG. 2) which is hinged to the housing 2 by means of hinge pins 14 located adjacent to the end wall 8. The cover assembly 12, likewise has sidewalls 6 and an end wall 8. Normally, the cover assembly 12 is in a lowered or closed position, but it may be swung backwardly about the hinge pins 14 to expose the interior of the housing 2. Extended between the cover assembly 12 and the portion of the housing 2 on which the assembly 12 rests are hydraulic cylinders 16 for lifting the cover assembly 12 and thereby moving it to its open position. The end wall 10 at the opposite end of the housing 2 is interrupted by an inlet opening 18 which aligns with the feed chute to permit the introduction of scrap metal into the shredder S.

Positioned outwardly on the housing 2 from the sidewalls 6 are supports 20 (FIG. 3) to which bearing assemblies 22 are secured, and the bearing assemblies 22 in turn support the rotor 4 which extends through the housing 2.

Attached to the inwardly presented surfaces of the sidewalls 6 on the housing 2 and likewise to the sidewalls 6 on the cover assembly 12 are grate bar supports 24 (FIGS. 2 and 4) having arcuate edges presented toward the rotor 4. Other portions of the sidewalls 6 on the housing 2 and cover assembly 12 are provided with side liners 26 having arcuate edges presented toward but spaced from the arcuate edges of the grate bar supports. These arcuate edges are of a smaller radius than the edges of the supports 24 so that an arcuate channel 28 exists between the grate bar supports 24 and the liners 26 on each of the sidewalls 6. The channels 28 extend for about 180° and are accessible when the cover assembly 12 is open. The end walls 8 of the housing 2 and cover assembly 12 are provided with end liners 30 as is that portion of the end wall 10 located above the inlet opening 18.

At the lower and inner end of the inlet opening 18, an anchor or bed plate 12 (FIG. 2) extends transversely across the housing 2 from the one sidewall 6 to the other and indeed projects laterally beyond the sidewalls 6. The bed plate 32 is welded firmly to the sidewalls 6 and to the end wall 10 and is inclined downwardly toward the interior of the housing 2 at an angle of between 25° and 45° with 30° being preferred. Along the rear or upper edge of the bed plate 32 a backing plate 34 projects upwardly from it for a short distance, and this plate 34 is fixed firmly in position with respect to the end plate 32. The portions of the bed plate 32 which project beyond the sidewalls 6 are located behind stop blocks 36 (FIG. 4) which are fixed firmly to the housing 2. The intermediate portion of the bed plate 32 located between the two sidewalls 6 is provided with elongated bolt holes 38 (FIG. 4) arranged in pairs with the longitudinal axes of all the holes 38 being parallel to the sidewalls 6.

The bed plate 32 supports a cutter bar 40 (FIGS. 2 and 5) which is rectangular in cross-section and has four longitudinal cutting edges 42. However, only one cutting edge 42 is effective at a time, that cutting edge being the upper and innermost edge 42. This cutting edge 42 is located below the axis of rotation for the rotor 4. The cutter bar 40 has bolt holes 44 (FIGS. 2, 4 and 5) which extend through it and each bolt hole 44 aligns with one elongated bolt hole 38 of each pair in the bed plate 32. Thus, only one elongated bolt hole 38 of each pair is occupied at a time. The holes 44 are countersunk at both ends to receive the heads of the bolts 46 which extend through them and through the bed plate 32 to secure the cutter bar 40 to the bed plate 32. The nuts for the bolts 46 are not tightened down directly against the bed plate 36, but instead are tightened against springs 48 which bear against the underside of the bed plate 32. The ends of the cutter bar 40 are provided with elongated bolt holes 50 (FIGS. 4 and 5) the longitudinal axes of which are likewise parallel to the housing sidewalls 6, and these bolt holes 50 receive end bolts 52 which project upwardly through the exposed ends of the bed plate 32. Again, the nuts for the bolts 52 are not tightened down directly against the cutter bar 40 but instead are tightened down against springs 48 which bear against the upper surface of the bar 40. The bolts 52 may be moved to laterally offset positions with the spacing between the original and offset positions being equal to the spacing between the elongated holes 38 of each pair in the bed plate 32.

Figure 4:
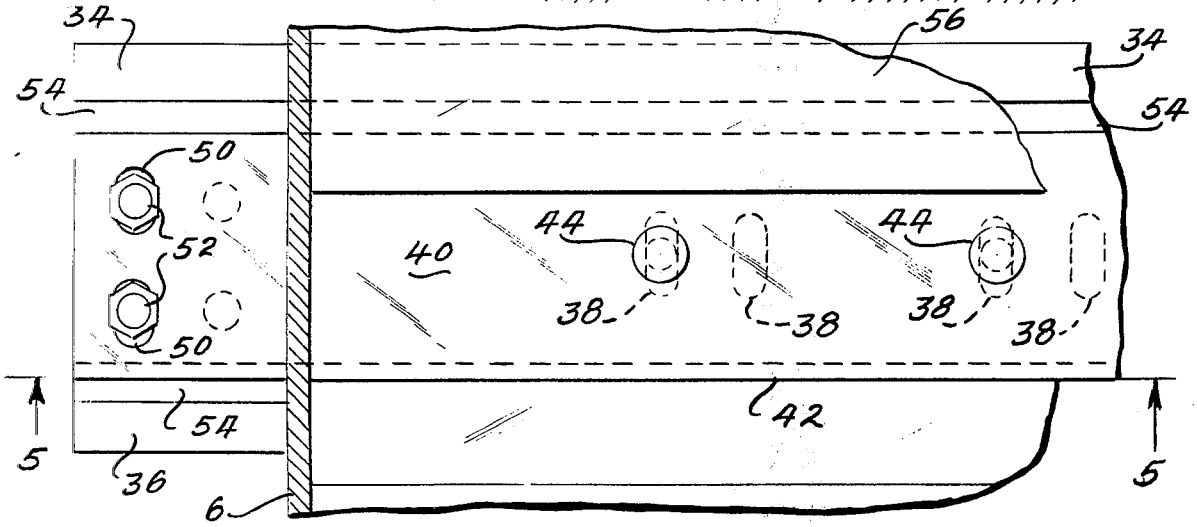
FIG. 4 is a fragmentary sectional view taken along lines 4—4 of FIG. 2 and showing the cutter bar of the shredder.
Figure 5:
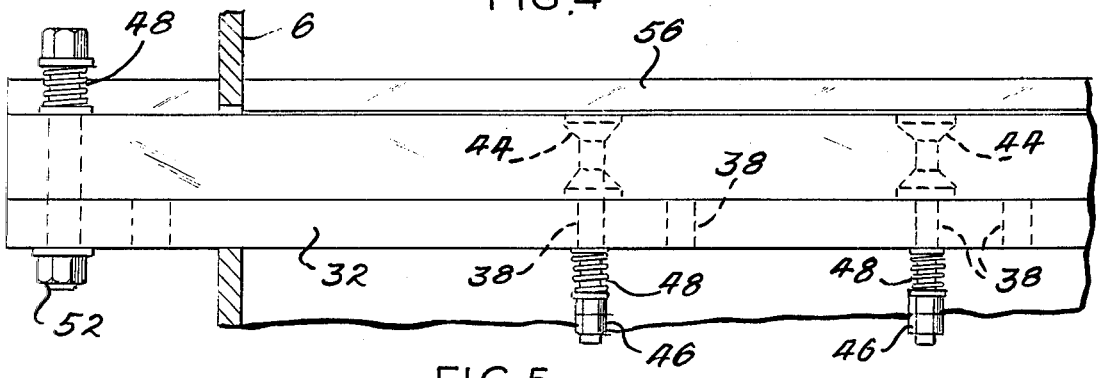
FIG. 5 is a fragmentary sectional view taken along lines 5—5 of FIG. 4.
Figure 2:
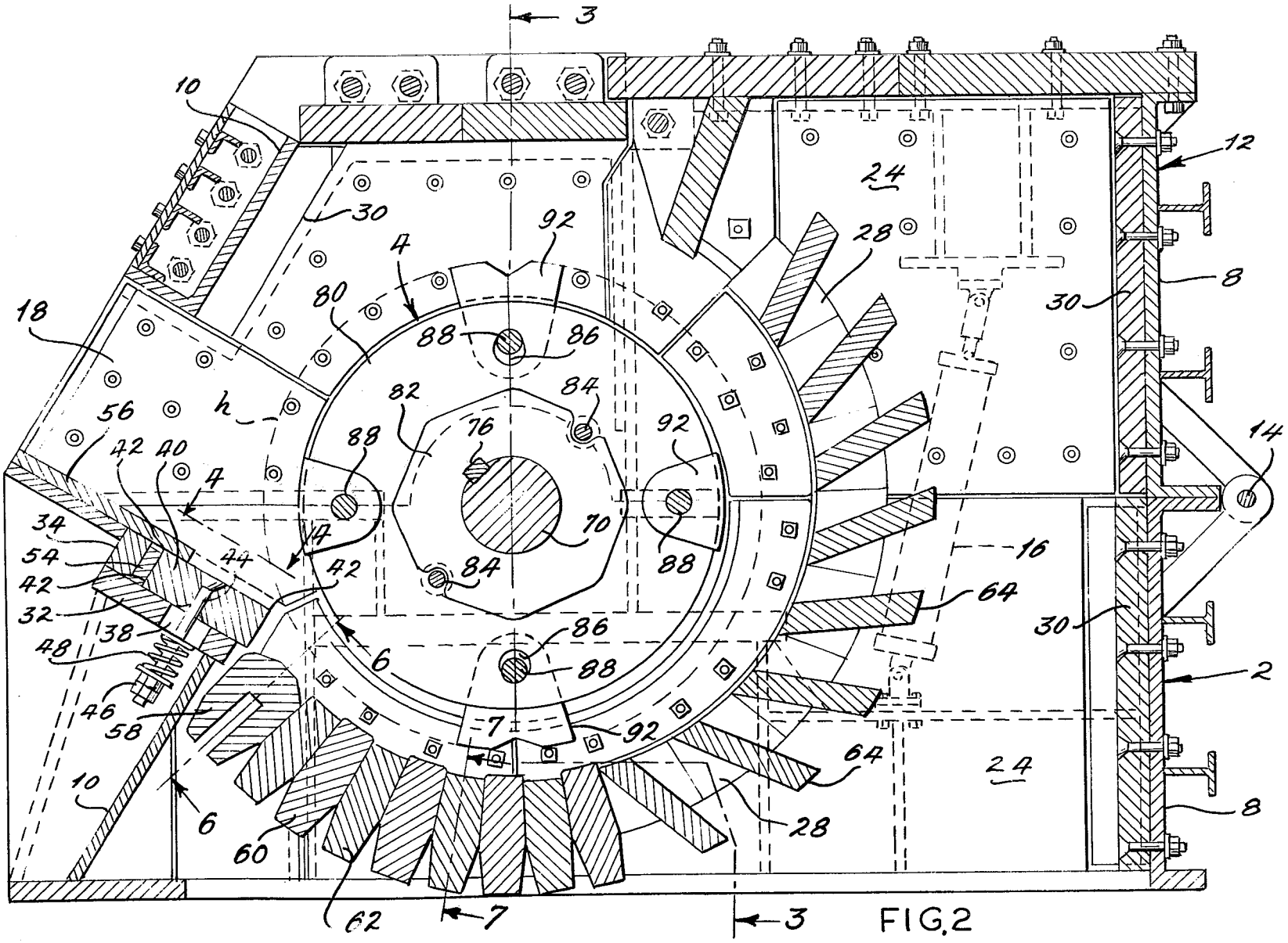
FIG. 2 is a sectional view of a shredder forming part of the overall shredding system.
Figure 3:
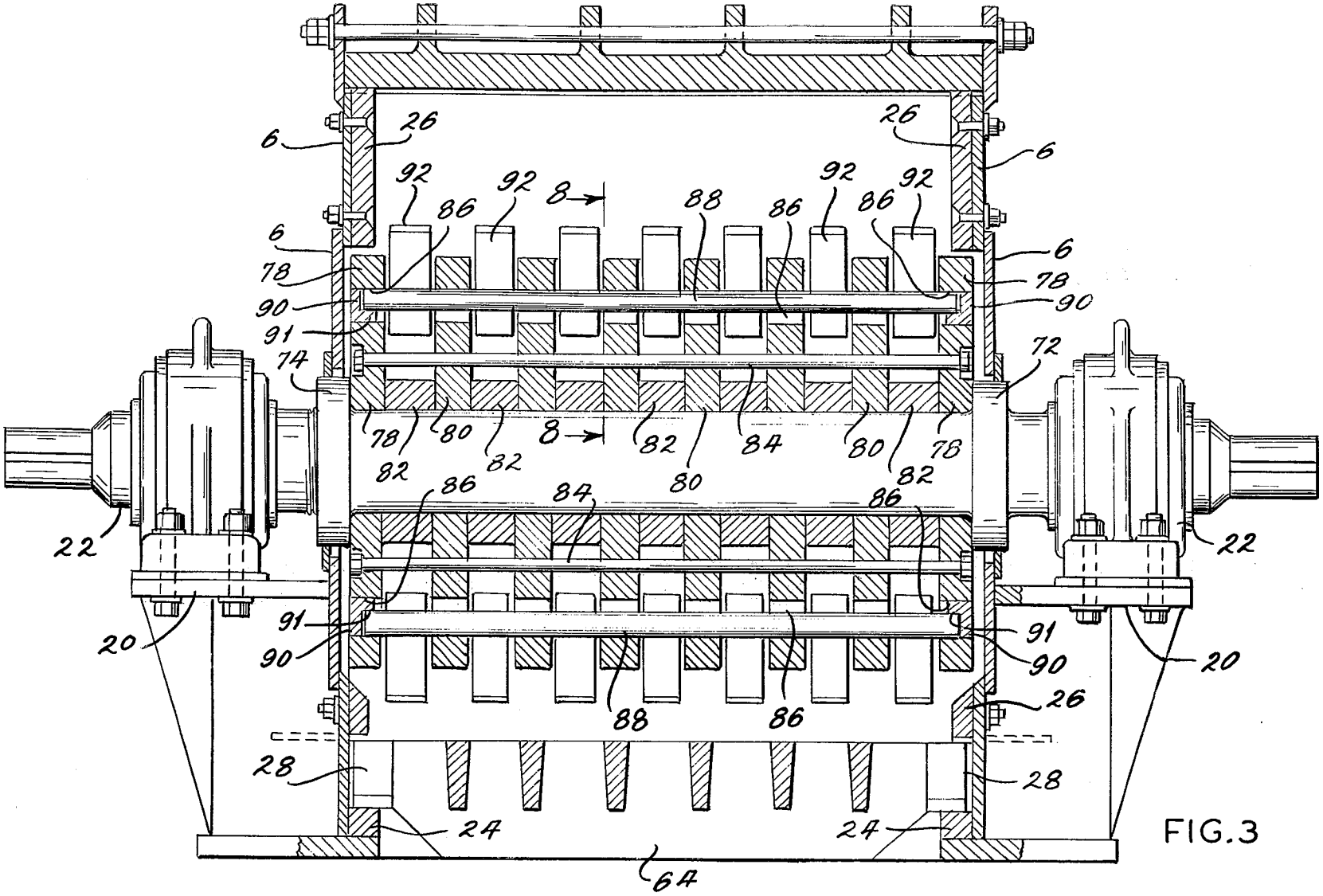
FIG. 3 is a sectional view taken along lines 3—3 of FIG. 2.
Figure 6:
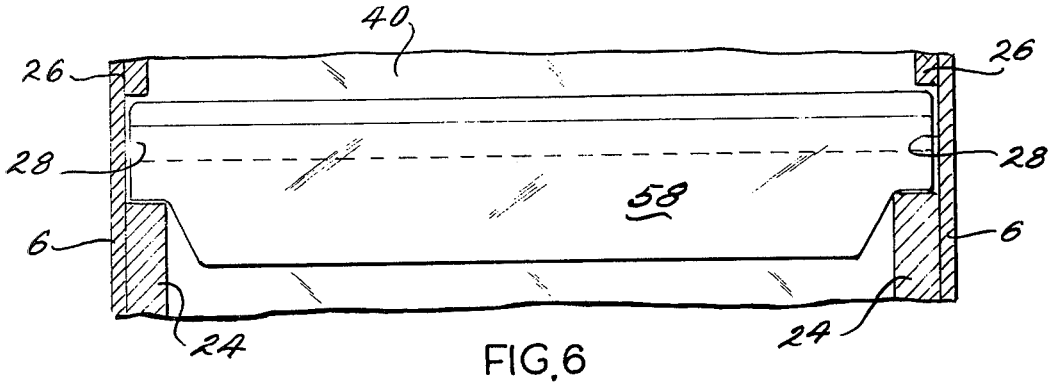
FIG. 6 is a fragmentary sectional view taken along lines 6—6 of FIG. 2 and showing the primary grinding plate of the shredder.
Figure 7:
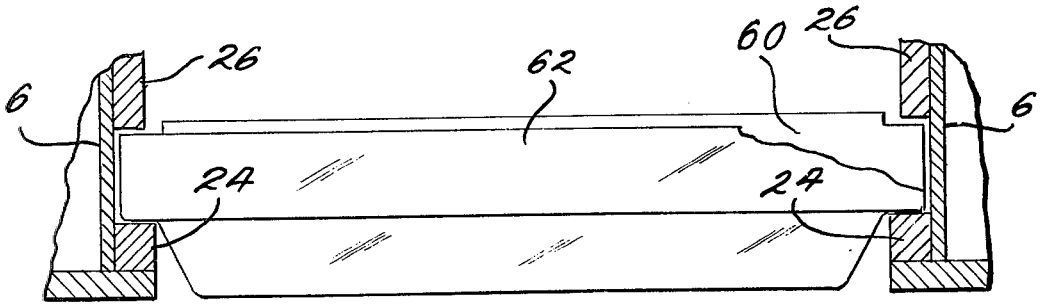
FIG. 7 is a sectional view taken along lines 7—7 of FIG. 2 and showing elevated and depressed secondary grinding plates of the shredder.

Since the bolt holes 38 in the bed plate 32 and the bolt holes 50 at the end of the cutter bar 32 are elongated, the bolts 46 and 52 which extend through them do not locate the cutter bar 40 in a fixed and determined position on the bed plate 32. On the contrary, the position of the cutter bar 40 is determined by front and back filler bars 54 (FIGS. 2 and 4). The front filler bars 54 are located between the stop blocks 36 and the front face of the cutter bar 40 and are disposed completely outwardly from the sidewalls 6. The rear filler bar 54 is located between the backing plate 34 and the rear face of the cutter bar 40 and extends the entire length of that face. Hence, the position of the cutter bar 40 on the bed plate 32 can be changed by varying the sizes of the filler bars 54, and this of course will move the effective cutting edges 42 of the bar 40 either closer to or farther from the rotor 4. Also, since the elongated holes 38 are arranged in pairs and the end bolts 52 can be moved to offset positions, the cutter bar 40 may be moved sideways, that is parallel to the axes of the rotor 4, a distance equalling the spacing between the elongated holes 38 of each pair and then again anchored in such a position.

That portion of the bottom of the inlet opening 18 located outwardly from the cutter bar 40 is defined by a bottom liner 56 which aligns with the bottom of the chute C and is located slightly above the cutter bar 40. Indeed, the bottom liner 56 extends completely over the backing plate 34, the rear filler bar 54, and a small portion of the cutter bar 40. Scrap metal is introduced into the machine along the bottom liner 56, and as it advances it passes over the cutter bar 40. The portion of the scrap which projects beyond the effective cutting edge 42 of the bar 40 is engaged by the rotor 4 and torn from the remainder of the scrap generally along the cutting edge 42. In short, the effective cutting edge 42 of the cutter bar 40 serves as a bed knife.

The front face of the cutter bar 40 is located at the lower ends of the arcuate channels 28 which are along the sidewalls 6. Extended across the housing 2 adjacent to the front face of the cutter bar 40 is a primary grinding plate 58 (FIGS. 2 and 6) having reduced ends which fit into the arcuate channels 28. The intermediate portions of the plate 58 are substantially thicker to provide strength. The upper surface of the primary grinding plate 58 is convex and is located below the effective cutting edge 42 of the cutter bar 40 so that the scrap cut at the bar 40 is driven downwardly against that surface. Thus, the primary grinding plate 58 functions as an anvil in that it takes repeated blows from the scrap which is cut. The primary grinding plate 58 is symmetrical so that it can be turned end for end when excessive wear develops along a portion of its convex surface.

Located beyond the primary grinding plate 58 are a series of secondary grinding plates 60 and 62 (FIGS. 2 and 7) which likewise have reduced ends fitted into the arcuate channels 28 and enlarged intermediate portions to provide adequate strength. The grinding plates 60 are elevated in that they project inwardly beyond the upper surfaces of the grinding plates 62 which are depressed. The two types of grinding plates 60 and 62 alternate so as to provide a somewhat staggered or uneven grinding surface beyond the cutter bar 40 and primary grinding plate 58. As scrap is drawn over this staggered surface by the rotor 4, it tends to snag on the elevated bars 60 and curl up into an extremely compact configuration. Also, the staggered surface causes oversize fragments to be further torn apart as they pass over the surface. The grinding plates 60 and 62 may be turned end for end, and the elevated plates 60, when worn down, may be substituted for the depressed plates 62 so that only the elevated plates 60 need be replaced when the shredder S is overhauled.

Beyond the staggered surface created by the grinding plates 60 and 62 the rotor 4 is enclosed by a grate formed by a plurality of grate bars 64 (FIG. 2). The ends of the grate bars 64 are disposed within the arcuate channels 28 where the sides of adjacent grate bars 64 abut. The intermediate portions of the grate bars 64, that is the portions spanning the space between the sidewalls 6 of the housing 2, are reduced in the circumferential direction so that spaces or openings exist between adjacent grate bars 64. The shredded material passes through these spaces.

The rotor 4 includes (FIGS. 2 and 4) a rotor shaft 70, which extends through the interior of the housing 2 and is supported at its ends in the bearing assemblies 22. One end of the rotor shaft 70 is connected to a suitable motor (not shown) for rotating the rotor 4. At one sidewall 6 the shaft 70 has an integral shoulder 72, while at the other sidewall 6 the shaft 70 is provided with threads over which a lock nut 74 is threaded. The portion of the shaft 70 which is within the housing 2, that is the portion between the shoulder 72 and nut 74, has a keyway machined into it and this keyway receives a key 76.

Fitted against the shoulder 72 and the lock nut 74 are end disks 78 (FIG. 3) which rotate adjacent to the sidewalls 6 of the housing 2. Between the two end disks 78, the shaft 70 carries a plurality of intermediate or center disks 80 and spacers 82 which separate the center disks 80 from one another and from the end disks 78 so that the rotor has a plurality of outwardly opening hammer slots at each spacer 82. The end disks 78, center disks 80, and spacers 82 are prevented from rotating on the shaft 70 by the key 76 and are all clamped tightly together by the lock nut 74 and also by a pair of tie rods 84 which extend through the disks 78 and 80 slightly outwardly from the spacers 82. In this regard, the ends of the tie rods 84 should be welded or peened over to prevent the nuts from working loose under the vibrations to which the rotor 4 is subjected. Also, during assembly, care should be exercised to insure that dirt or metal fragments do not become lodged between the spacers 82 and center disks 80 and thereby impair the rigidity of the rotor 4.

Figure 8:
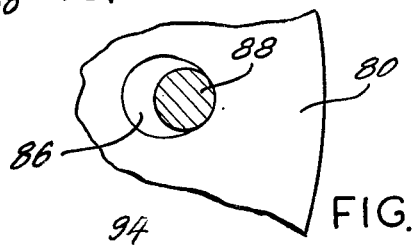
FIG. 8 is a fragmentary sectional view of a portion of the rotor for the shredder.
Figure 9:
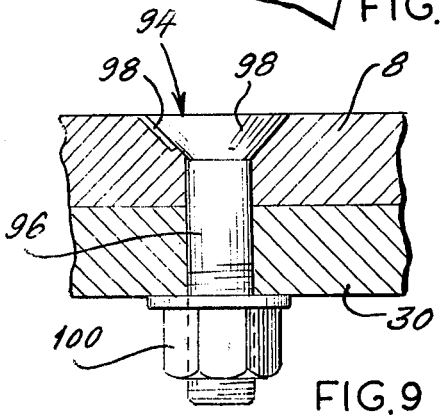
FIG. 9 is a fragmentary sectional view of the shredder housing and showing fasteners for securing liners to the housing.

Outwardly from the tie rods 84 the end disks 78 and center disks 80 are provided with four sets of hammershaft holes 86, with the sets of holes being located 90° from one another. Each set receives a separate hammershaft 88. The hammershafts 88 are of circular configuration, whereas the holes 86 are generally pear-shaped in configuration (FIG. 8). In particular, the portion of each hole 86 which is located farthest from the rotor shaft 70 is about the same radius as the shaft 88 or slightly larger, while portions located closest to the shaft 70 is considerably larger than the shaft 88. When the rotor 4 revolves, the centrifugal forces on the shafts 88 will cause them to move outwardly and fit snugly in the small portions of the holes 86. The holes 86 in the end disks 78 retain plugs 70 which prevent the hammershafts 88 from moving axially, and these plugs have integral fillers 91 which occupy the enlarged portions of the holes 86 in the end disks 78 and prevent the hammershafts 88 from entering the enlarged portions of all the holes 86. When the rotor 4 is at rest and the plugs 90 are removed, the hammershafts 88 may move into the large inner portions of the holes 86. This facilitates removal of the shafts 88, particularly where a shaft 88 is bent or otherwise distorted in some manner. Also, in contrast to conventional shredders where debris tends to lodge in the small clearance areas surrounding hammershafts, thereby making them extremely difficult to remove, the extremely large clearance areas afforded by the holes 86 do not as easly retain such debris. Even if debris collects and cakes in the enlarged portions of the holes 86, it can be easily chiseled out of those portions.

The hammershafts 88 pass through hammers 92 which are contained in the outwardly opening slots between center disks 80 and also between the end disks 78 and the center disks 80 located immediately inwardly from them. The hammers 92 are free to swing backwardly and forwardly on the hammershafts 88, and when the rotor 4 revolves they assume an outwardly directed portion in which they project beyond the center disks 80. As the hammers 92 rotate, they define hammer paths or circles *h* (FIG. 2) which pass close to the effective cutting edge 42 of the cutter bar 40, as well as by the primary grinding plate 58, the secondary grinding plates 60 and 62, and the grate bars 64. The filler bars 54 which position the cutter bar 40 on the bed plate 32 should locate the effective cutting edge 42 about ½ inch from the hammer circle *h*.

The side faces of the hammers 92 are flat (FIG. 2) and the spacers 82 along their peripheries have flat surfaces located immediately inwardly from the hammers 92. These surfaces are positioned such that should a hammer 92 swing inwardly as a result of striking a heavy piece of scrap or as a result of the rotor 4 slowing down, the side faces of the hammers 92 will come against the flat surfaces of the spacers 82 so that the impact is spread over a relatively large area.

In operation, scrap is introduced into the inlet opening 18 of the housing 2 and as it passes over the effective cutting edges 42 of the cutter bar 40, the hammers 92 tear into it and rip it into fragments. These fragments are driven against the grinding plates 58, 60 and 62 where they are reduced still further, and as the fragments are dragged across the staggered surface created by elevated and depressed grinding plates 60 and 62, they tend to curl or roll up into an extremely condensed configuration. Those fragments which are small enough to pass through the spaces between the grate bars 64 do so while oversize fragments are carried around until they are that small.

The shredding action causes the hammers to wear and thereby reduce the diameter of the hammer circle *h*, and in order to compensate for this reduction in the size of the hammer circle *h*, the cutter bar 40 may be moved forwardly to again bring its effective cutting edge 42 to the proper distance from the hammer circle *h*. This is achieved by loosening the bolts 46 and 52 and replacing the filler bars 54 with filler bars 54 of different thickness. The bolts 46 and 52 are then retightened. In time, the abrasive action of the scrap being drawn across the cutter bar 40 will create grooves in the cutter bar 40 directly opposite the paths described by the hammers. However, the cutting edge 42 will remain relatively sharp directly opposite the center disks 80 which are between the hammer paths *h*. These sharp portions of the cutting edges 42 are then utilized by moving the cutter bar 40 laterally a distance equal to the spacing between the hammer paths *h*. In this connection, it should be noted that the spacing between the elongated bolt holes 50 of each pair in the bed plate 32 equals the spacing between adjacent center disks 80 on the rotor 4 so that when the bolt 46 are removed from the holes 50 of a pair and placed in the other holes 50 of the pair and the bolts 44 are likewise removed and placed in offset holes, the cutter bar 40 is repositioned to make use of the sharp portions of the cutting edges 42 remaining on it. When those portions wear the cutter bar 40 may be turned, and the procedure is repeated until all four of the cutting edges 42 are worn down, at which time the cutter bar 40 must be replaced.

The elevated and depressed grinding plates 60 and 62 will also wear, and when the clearance between them and the hammer circle *h* becomes too great, the depressed grinding plates 62 are removed and replaced by the worn elevated grinding plates 60. The worn elevated grinding plates 60 are in turn replaced by new elevated grinding plates 60. In this regard, the wear on the elevated grinding plates 60 tends to reduce them to the size of the depressed grinding plates 62 so that only the elevated grinding plates need be replaced.

When the hammers 92 wear to the extent that they are no longer serviceable, the hammershafts 88 are pulled axially from the rotor 4 without disassembling the rotor 4. Hence, the rigidity or alignment of the rotor 4 is not disturbed. Since the hammershaft holes 86 are substantially larger than the hammershaft 88, the shaft 88 is easily withdrawn from them even if it is bent or otherwise distorted. Should any debris become lodged in the enlarged portions of the hammershaft holes 86, that material may be easily removed with a hammer and chisel.

The shredder S generates tremendous vibrations in operation, particularly at the side liners 26 and end liners 30 as a result of the shredded fragments coming against them. In order to eliminate down time for tightening the bolts which hold the liners 26 and 30 in place, special bolt fasteners 94 (FIG. 9) are employed. Each fastener 94 includes a bolt 96 formed from forged steel which is heat treated to a specific hardness. The head of the bolt 96 is of countersunk variety and is provided with three longitudinally extending ribs 98 on the beveled surfaces thereof. These ribs sink into the liner and prevent the bolt 96 from turning. The shank of the bolt 96 has national fine threads over which a conventional nut 100 is threaded. The steel of the nut 100 is substantially softer than the steel of the bolt 96, and the nut 100 is tightened until a partial distortion of its threads occurs. For a 1½ inch diameter bolt, this requires about 2000 ft. lbs. torque. The nut 100 will not shake loose and should not be disturbed until the liners 26 and 30 are replaced. The bolts 96 are most easily removed with a torch. Since the countersunk heads of the bolts 96 wear with the liners 26 and 30, the bolts 96 should be reused.

The Chute

Figure 10:
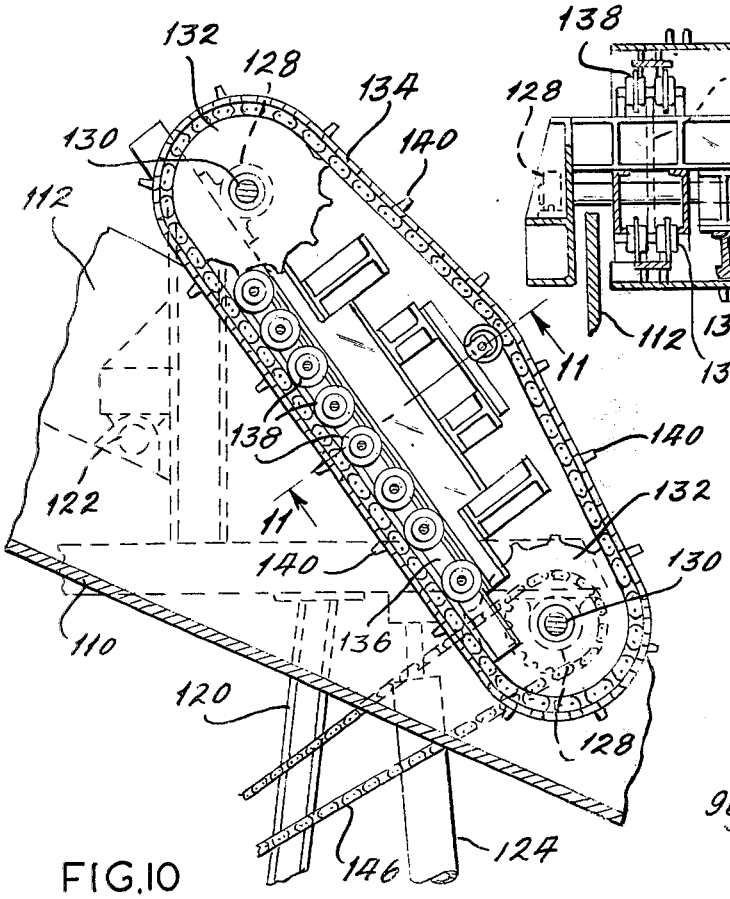
FIG. 10 is a sectional view of the track feeder for advancing scrap to the shredder.

The chute C (FIGS. 1 and 10) leads to the inlet opening 18 of the shredder housing 2, and is defined by a bottom ramp 110 and sidewalls 112. The spacing between the sidewalls 112 should be great enough to accommodate the object to be shredded which is usually an automobile body. The bottom ramp 110 is flat and aligns with the bottom liner 56 of the shredder S. It is inclined at the same angle as the bottom liner 56 which angle is preferably 30°. The chute C should have substantial length and when used with automobiles it should be long enough to accommodate three automobiles. The chute C is supported on a framework 114 which rests on the foundation P.

The Track Feeder

The track feeder F is supported on both the framework 114 for the chute C and on the foundation P and includes a movable frame 120 (FIGS. 1 and 10) which extends along each side of the chute C as well as under and over it. The frame 120 pivots near its rear end on a bearing 122 secured to the framework 114 for the chute C, while its forward end is supported by hydraulic cylinders 124 which rest on a pier 126 projecting upwardly from the foundation P. Thus, extension or retraction of the cylinder 124 will cause the frame 120 to pivot about its bearings 122.

Figure 11:
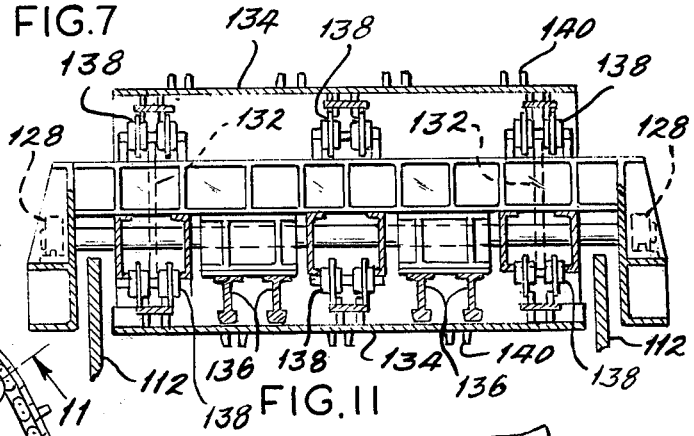
FIG. 11 is a sectional view taken along lines 11—11 of FIG. 10.

The portion of the frame 120 which is located above the bottom ramp 110 of the chute C has two sets of aligned bearings 128 (FIGS. 10 and 11) which support two parallel end shafts 130 having sprocket wheels 132 on them. Trained over these sprocket wheels 132 is an endless track 134 which may be several tractor tracks positioned side by side. In any event, the track 134 extends substantially the full width of the chute C, that is its width is about equal to the spacing between the sidewalls 112 (FIG. 11). At the upper or rear end of the framework 114, the lower pass of the track 134 should be about as high as the object to be shredded which is usually an automobile. The height of the lower or forward end is controlled by the cylinders 124. Usually, the lower pass of the track 134 slopes downwardly toward the ramp 110 so that objects caught between it and the ramp 110 will be crushed. The lower pass on the track 134 is backed by several longitudinal skid bars 136 and idler rollers 138 located between the skid bars 136, all prevent that pass from bowing upwardly around an object instead of crushing it. Most of the idler rollers 138 are located at the upper end of the track feeder F since that is where most of the crushing occurs. The upper pass of the track 134 is supported by more idler rollers 138. The track 134 has teeth or lugs 140 which project outwardly from the exposed surface thereof and bite into material conveyed along the chute C. Thus, the track 134 firmly engages scrap located beneath it and can control the advance of the scrap on the chute C. Hence, the track feeder F is also referred to as advancing means or crushing means.

The portion of the frame 120 which extends below the chute C carries a platform 142 on which a reversible electric motor 144 (FIG. 1) is mounted, and this motor is connected to the lower of the two end shafts 130 through a suitable drive train 146 which includes a gear reduction and a chain.

OPERATION

In operation, an automobile or other large piece of scrap is placed on the chute by means of a crane, and once the crane releases the automobile it slides downwardly toward the lower pass of the track 134 on the feeder F (FIG. 1). The lower pass moves toward the inlet opening 18 of the shredder S and as it does, the lugs 140 on it bite into the automobile and move it forwardly along the ramp 110. Moreover, the lower pass of the track 134 converges toward the ramp 110 so that as the automobile moves forwardly it is compressed or crushed downwardly against the ramp 110.

The cylinders 124 are adjusted to place the lower end of the track 134 about 24 inches above the bottom ramp 110 so that the automobile upon emerging from the track feeder F is reduced to a height of about 24 inches.

Upon emerging from the track feeder F, the automobile enters the inlet opening 18 of the shredder S. When the automobile passes over the cutting edge 42 of the cutter bar 40, the hammers 92 tear into it and reduce it to fragments. The track feeder F controls the rate at which the automobile enters the inlet opening 18. In particular, the track 134, being engaged with the automobile through the lugs 140, feeds the automobile at a uniform rate and thereby prevents the automobile from being drawn too quickly into the shredder S by the rotating hammers 92. This eliminates jams and further increases the life of the various parts within the shredder S. The track feeder F also prevents the rotor 4 from expelling or refusing to accept an automobile in that the track 134 forces the automobile into the inlet opening 18. By reversing the motor 144, the track 134 is reversed, and this feature is useful in clearing jams.

THE HYDRAULIC SYSTEM

The cylinders 124 which control the position of the track feeder F above the bottom ramp 110 of the chute C are connected into a hydraulic system H (FIG. 12–16) which affords two modes of operation for the cylinders 124, namely a manual or direct control mode and a balance or automatic floating mode. The cylinders 124 are of the double acting variety and are positioned with their barrels connected to the pier 126 and their piston rods connected to the track feeder F. Hence, when fluid is formed into the cap ends of the cylinders 124, the cylinders 124 will exert an upwardly directed force on the track feeder F.

The hydraulic system H includes a high pressure pump P1 and variable volume pump P2, both of which are powered by a single motor M. The pumps P1 and P2 draw hydraulic fluid from a reservoir R. Moreover, the pump P2 is adjustable much the same as an adjustable relief valve so that when it works against a pressure greater than its own setting the fluid is merely discharged through the drain line *d* of the pump. In addition to the pumps P1 and P2, the hydraulic system H includes four solenoid operated valves, V1, V2, V3 and V4 and four adjustable relief valves RV1, RV2, RV3 and RV4. The solenoid valve V1 is operated by two solenoids A and B, the solenoid valve V2 by a single solenoid C, the solenoid valve V2 by two solenoids D and E, and the solenoid valve V4 by a single solenoid F. In a typical installation the relief valve RV1, RV2, RV3 and RV4 are set at 1400, 400, 950, and 150 psi, respectively, and the relief valve RV3 is always set higher than the pump P2. The four lines leading into the ends of the cylinders 124 have flow control valves FC in them to control the rate at which fluid leaves the cylinders 124. Each flow control valve FC is shunted by a check valve CV which permits the fluid to bypass the flow control valve FC as it enters the cylinders 124. The pumps P1 and P2, the check valves V1, V2, V3 and V4 the relief valves RV1, RV2, RV3 and RV4, the flow control valves FC and the check valves CV are all connected together and with the cylinders 124 as illustrated in the drawings (FIGS. 12–16 in which solid lines indicate fluid in motion and interrupted lines indicate fluid at rest).

Figure 12:
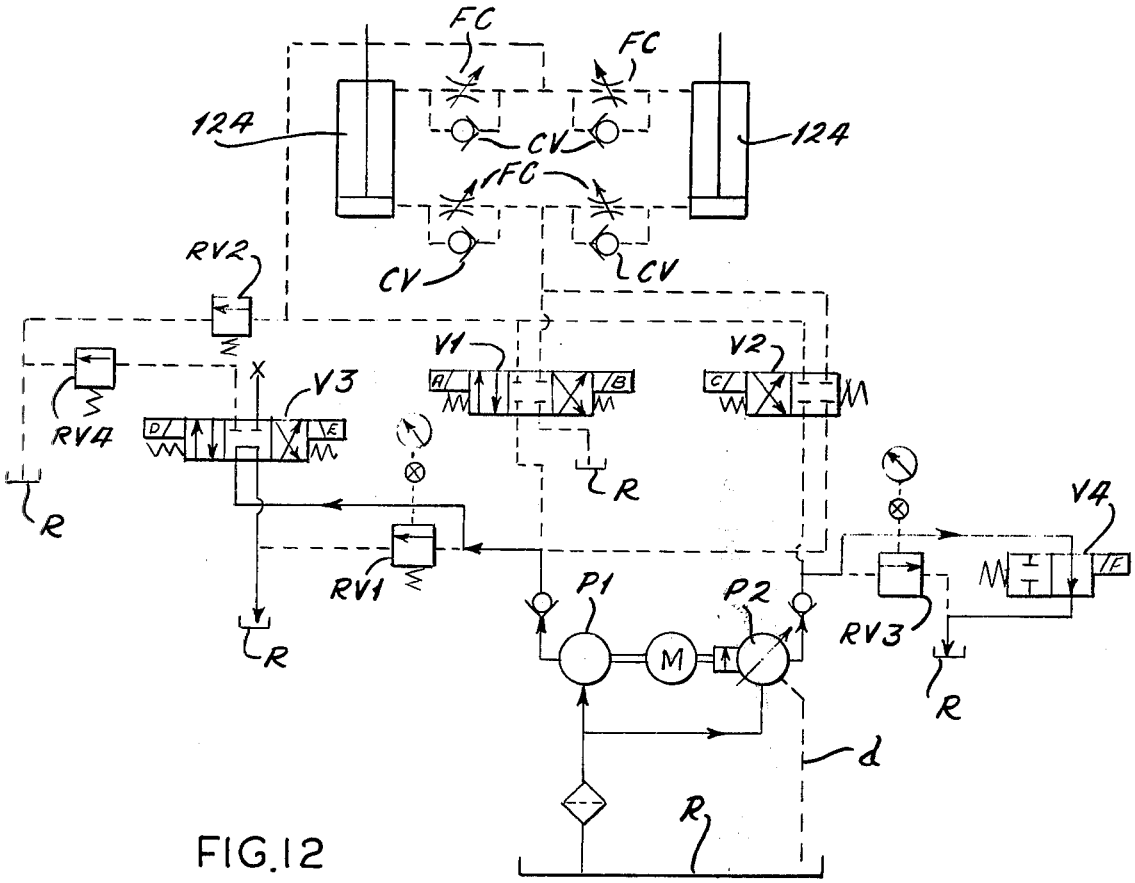
FIG. 12 is a schematic view of the hydraulic circuit for positioning the track feeder, the circuit being in its manual mode for start up.

1. Manual Mode — Start Up (FIG. 12)

The motor M should not be loaded until it reaches operating speed. Thus, for start-up the operator energizes only the solenoid F. As a result, fluid discharged from the pump P1 is circulated through the valve V3 and back to the reservoir R (solid lines in drawings indicate fluid in motion). The valve V3 diverts the fluid around the relief valve RV1, thereby keeping the pressure at the discharge port of the pump P1 minimal. The fluid discharged by the pump P2 is also circulated back into the reservoir R, since the energized solenoid F holds the valve V4 open, thus creating a shunt around the relief valve RV3.

Since both of the valves V1 and V2 are completely closed the hydraulic fluid is in effect trapped in the cylinders 124 and the track feeder F can neither be raised nor lowered by external forces applied to it.

Figure 13:
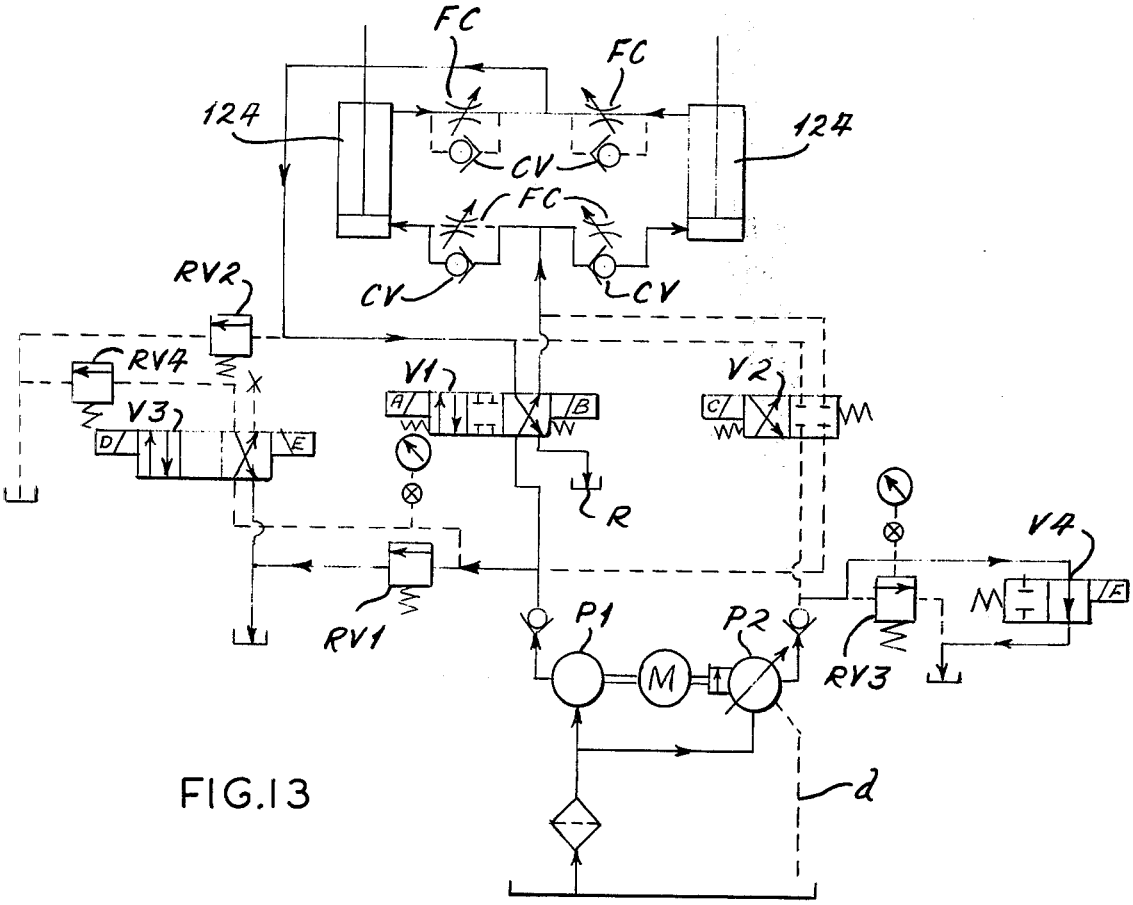
FIG. 13 is a schematic view of the hydraulic circuit in the manual mode for raising the track feeder.

2. Manual Mode — Raise (FIG. 13)

To raise the track feeder the operator presses a control button which energizes the solenoids B, E and F. As a result, the fluid is no longer diverted around the relief valve RV1 by the valve V3, but instead the valve V3, when energized by the solenoid E, in effect blocks bypass around the relief valve RV1. Hence, any excess fluid discharged by the pump P1 passes through the relief valve RV1 before flowing back into the reservoir R. This raises the pressure at the discharge side of the pump R1 to the setting of the relief valve RV1.

The valve V1 when actuated by the solenoid B permits the high pressure fluid to flow through it to the cap ends of the cylinder 124, thus causing the piston rods to extend and lift the track feeder F. The return fluid from the rod ends of the cylinders 124 flows through the valve V1 to the reservoir R. The flow control valves FC at the rod ends of the cylinders 124 are adjustable and control the rate of discharge from the cylinders 124, thus regulating the speed at which the track feeder F rises. The pressure at the cap ends of the cylinders 124 is dependent on the setting of the relief valve RV1 and that relief valve has the highest setting of all the relief valves.

The energized solenoid F keeps that valve V4 open so that fluid from the pump P2 is circulated back into the reservoir R without having an effect on the cylinders 124.

Figure 14:
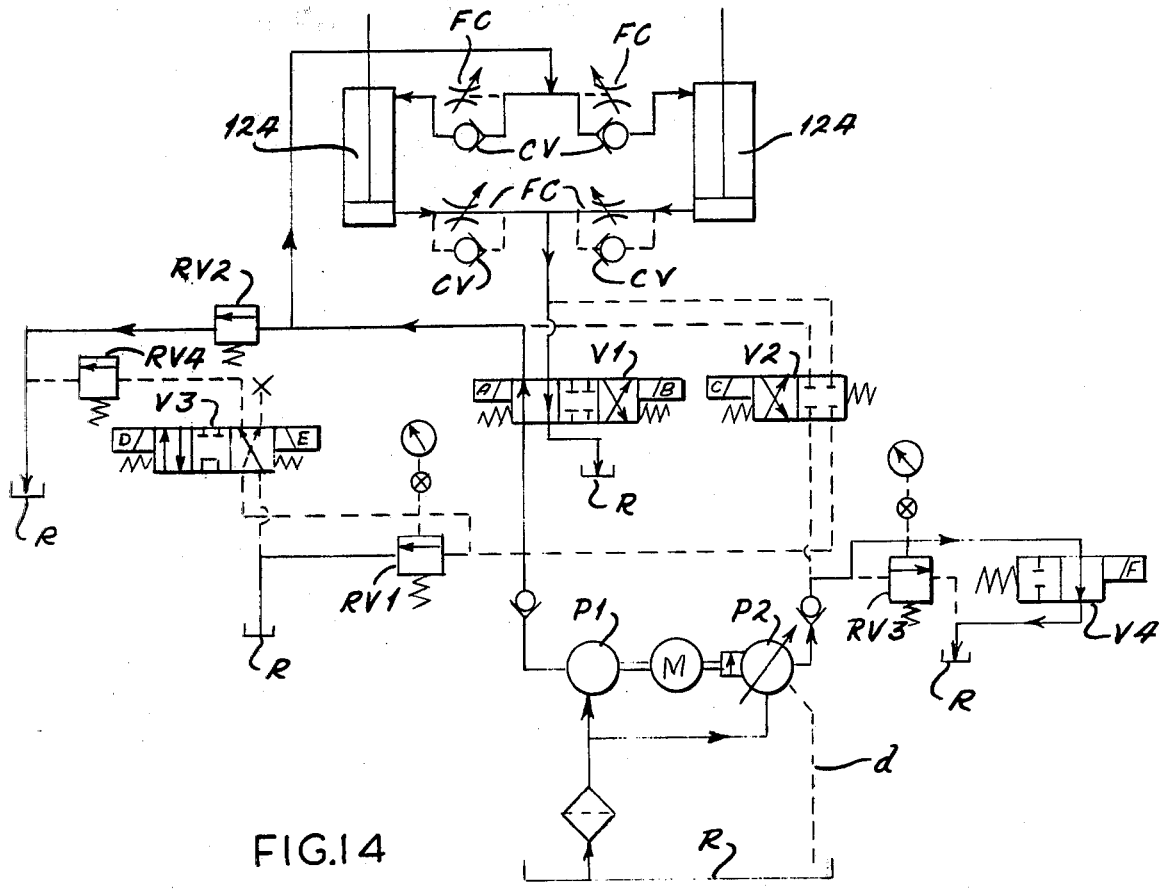
FIG. 14 is a schematic view of the hydraulic circuit but in the manual mode for lowering the track feeder.

3. Manual Mode — Lower (FIG. 14)

Sometimes a stubborn automobile or the other item of scrap overcomes the weight of the track feeder F and lifts it upwardly to the extent that the item will not be crushed sufficiently by the shredder S. To supplement the weight of the track feeder F, high pressure fluid is supplied to the rod ends of the cylinders 124, so that the cylinders 124 force the track feeder F downwardly.

The foregoing crushing effect is achieved by energizing the solenoids A, E and F. The solenoid E causes the valve V3 to block the path of return to the reservoir R. The solenoid A on the other hand causes the valve V1 to divert the high pressure fluid to the rod ends of the cylinders 124 and force the track feeder F downwardly. However, the downwardly directed force is not as great as the upwardly directed force since the relief valve RV2 which is set lower than the relief valve RV1, is in the high pressure line between the valve V1 and the rod ends of the cylinders 124. As a result, the pressure at the rod ends of the cylinders 124 never exceeds the setting of the relief valve RV2. As an example, if the relief valve RV1 as set at 1400 psi, the relief valve RV2 should be set at 400 psi.

The return fluid from the cap ends of the cylinders 124 passes through the flow control valves FC and then through the valve V1 to the reservoir R. The flow control valves FC prevent the fluid from discharging too rapidly from the cylinders 124 which in turn prevents the feeder F from dropping too rapidly.

The valve V4, which is actuated by the energized solenoid F, continues to circulate the fluid from the pump P2 back to the reservoir R, thus rendering the pump P2 ineffective.

Figure 15:
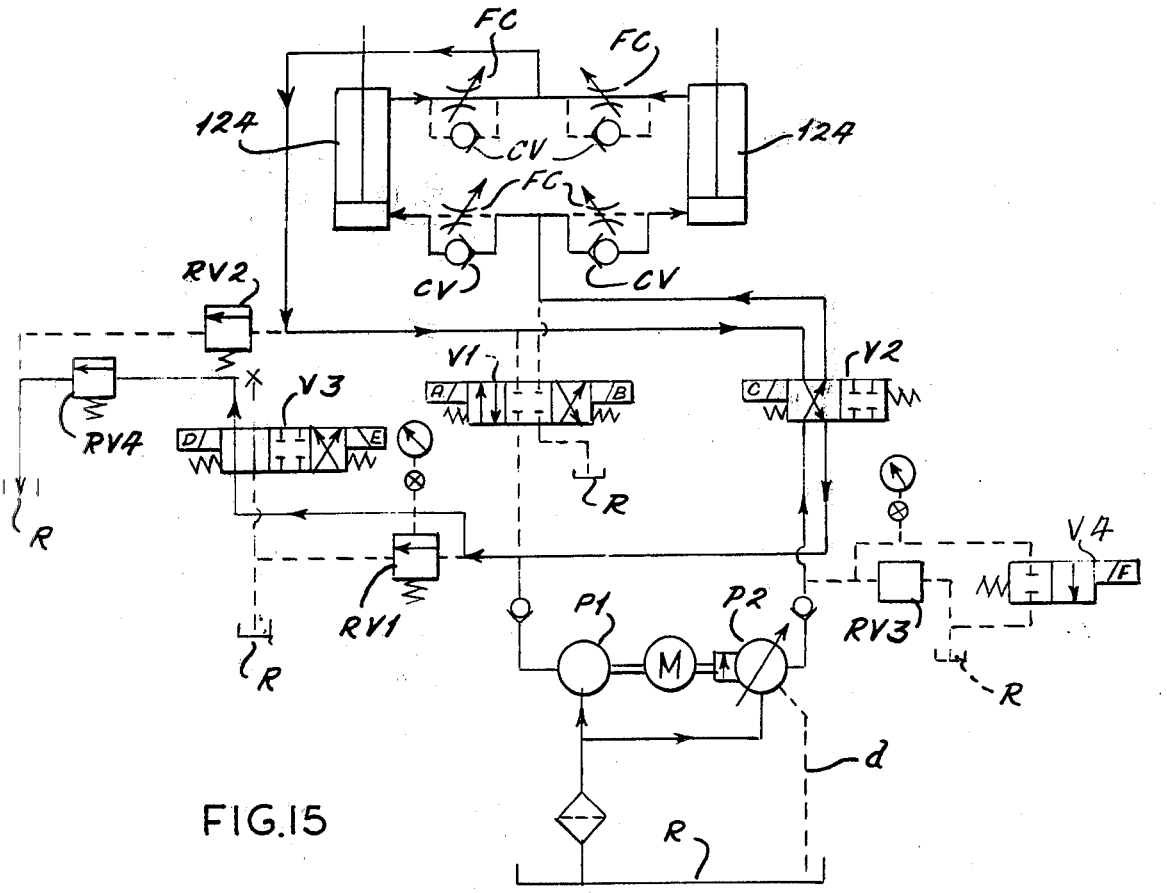
FIG. 15 is a schematic view of the hydraulic circuit when in the balance or automatic mode with the scrap forcing the track feeder upwardly.

4. Balance Mode — Track Feeder Elevated by Scrap (FIG. 15)

In normal operation it is desirable to have the track feeder apply a predetermined force to the scrap items passing beneath it in the chute. The constant force applied by the track feeder should be somewhat less than the weight of the track feeder F so that the track feeder F floats over the scrap passing beneath it, crushing that scrap as it does.

To achieve this constant force floating condition, the operator turns a selector switch which energizes only the solenoids C and D.

The solenoid C opens the valve V2 so that fluid from the pump P2 flows through the valve V2 to the cap ends of the cylinders 124 and exerts an upwardly directed force on the track feeder F. The force exerted is dependent on the setting of the pump P2 and that setting is always less than the setting of the relief valve RV3.

When an automobile causes the track feeder to move upwardly, fluid from the pump P2 flows into the cap ends of the cylinders 124. The return fluid from the discharge ends of the cylinders 124 flows back through the valve V2 and then through the valve V3 which is held open by the solenoid D. The valve V3 directs the return fluid through the relief valve RV4 which discharges into the reservoir R. The relief valve RV4 has the lowest setting of all the relief valves in the system, and hence the return fluid does not escape through the relief valves RV2 and RV1. Likewise, the supply fluid does not escape through the relief valve RV3.

The pump P1 has no function when the feeder rises and all of its fluid passes through one relief valve RV4 and back into the reservoir R.

Figure 16:
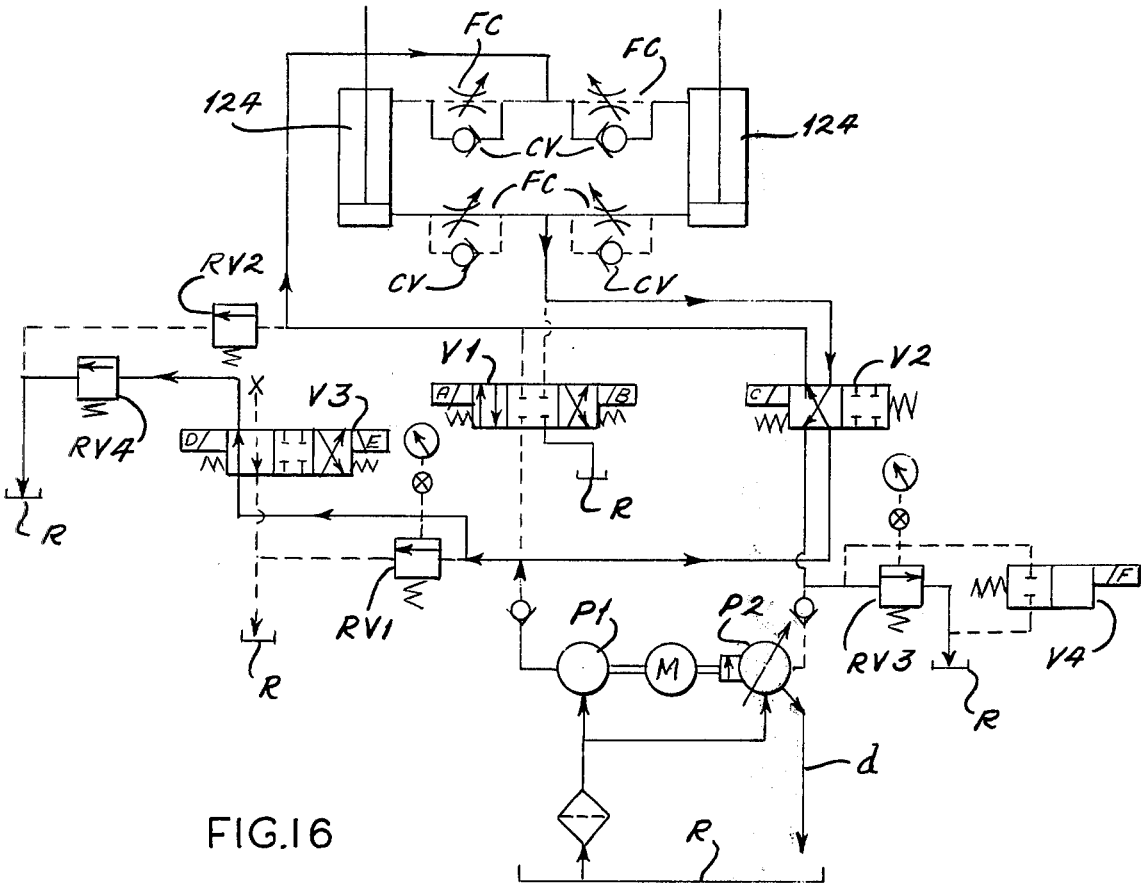
FIG. 16 is a schematic view of the hydraulic circuit in the balance mode with the track feeder descending under its own weight due to inadequate resistance offered by the scrap beneath it.

5. Balance Mode — Track Feeder Descending Under Own Weight (FIG. 16)

When the weight of the track feeder F overcomes the strength of the scrap supporting it, the track feeder F moves downwardly and fluid is forced from the cap ends of the cylinders 124. Since the balance mode is purely automatic only the solenoids C and D remain energized as before. The fluid from the cap ends of the cylinders 124 flows back through the valve V2 and into the reservoir R through the relief valve RV3. In this regard, the relief valve RV3 is always set higher than the discharge pressure of the pump P2 so that fluid discharged from the pump P2 is merely directed back to the reservoir R through the drain line *d*.

Makeup fluid is supplied to the rod ends of the cylinders by the pump 1, that fluid being directed through the valve V2.

What is claimed is:

1. A feeder for feeding large items of bulk scrap to a reducing machine which reduces the scrap to segments, said feeder comprising: a chute for receiving bulk scrap and having a bottom surface on which the scrap is supported; advancing means located above the supporting surface of the chute for engaging the scrap and moving it along the chute; at least one fluid operated cylinder for supporting the advancing means above the supporting surface of the chute; first and second pumps for supplying fluid to the hydraulic cylinder, the first pump being capable of elevating the pressure of the fluid sufficiently to overcome the weight of the advancing means, the second pump supplying fluid to the cylinder at a pressure less than that required to overcome the weight of the advancing means so that the advancing means will float on the scrap, exerting a force thereon less than; the force required to hold it away from the bottom surface of the chute whereby the feeder is supported by both the scrap and the cylinder; first valve means between the first pump and the cylinder for directing high pressure fluid to the cylinder such that it will raise the advancing means; and second valve means between the second pump and the cylinder for directing pressure to the cylinder to exert a force on the advancing means in opposition to the weight of the advancing means.

2. A feeder according to claim 1 wherein the first valve means is also capable of directing fluid to the cylinder such that the force exerted by the advancing means on the scrap is greater than the weight of the advancing means.

3. A feeder according to claim 1 wherein a first relief valve is interposed between the second pump and the second valve means, the relief valve being set at a pressure greater than the discharge pressure of the second pump so that when the second valve is open and the advancing means descends the fluid displaced from the cylinder will escape through the first relief valve.

4. A feeder according to claim 3 wherein the first pump is also connected to the second valve means to supply makeup fluid to the cylinder through the second valve means as the advancing means descends.

5. A feeder according to claim 4 including a second relief valve connected to the second valve means for receiving return fluid from the cylinder when the second valve means is open, and third valve means for isolating the second relief valve from the first pump and the second valve means.

6. A feeder according to claim 5 wherein a third relief valve is connected to the first pump and wherein the third valve means in one condition directs fluid around the third relief valve and in another condition causes fluid to flow through the third relief valve.

7. A machine for advancing material and for crushing the material as it is advanced, said machine comprising: a chute along which the material is advanced and having a bottom surface on which the material is supported; crushing means located above the bottom surface of the chute for exerting a downwardly directed force on the material on the chute so as to crush the material, the crushing means having a downwardly presented surface which faces the bottom surface of the chute and contacts the material as it moves along the chute; fluid operated cylinder means connected to the crushing means for exerting a vertically directed force on the crushing means; first pump means connected to the cylinder means for supplying pressurized fluid to the cylinder means at a pressure sufficient to overcome the weight of the crushing means and thereby move its downwardly presented surface away from the bottom surface of the chute; second pump means also connected to the cylinder means for supplying pressurized fluid to the cylinder at a pressure less than that required to overcome the weight of the crushing means, whereby the crushing means exert a reduced force on the material; and valve means between the first and second pump means and the cylinder means for directing fluid from the first and second pump means to the cylinder means.

8. A machine according to claim 7 wherein the cylinder means is capable of exerting a force on the crushing means which supplements the weight of crushing means so that a force supplementing the weight of the crushing means may be applied to the material; and wherein the valve means controls the vertical direction in which the force exerted by the cylinder means is applied.

9. A machine according to claim 7 wherein the downwardly presented surface of the crushing means moves in the direction the material is advanced and assists in advancing the material.

10. A machine according to claim 9 wherein the crushing means pivots about a horizontal axis which is fixed which respect to the chute, and the cylinder means is connected to crushing means remote from the horizontal axis.

11. A machine for advancing material and crushing the material while it is advanced, said machine comprising: a chute having a bottom surface on which the material is supported; advancing means located above the bottom surface of the chute for advancing the material along the chute and for crushing the material as it is advanced, the advancing means having a downwardly presented surface which faces the bottom surface of the chute and moves in the direction of advance for the material so that material which comes in contact with the downwardly presented surface is moved along the chute, the advancing means being movable in the vertical direction so that the spacing between its downwardly presented surface and the upwardly presented surface can be varied; fluid operated cylinder means connected to the advancing means for exerting a force on the advancing means in opposition to the weight of the advancing means and for also exerting a downwardly directed force on the advancing means to supplement the weight of the advancing means; pump means for supplying pressurized fluid to the cylinder means at at least two different pressures so that an upwardly directed force is exerted on the advancing means and including a first pump capable of producing the one pressure and a second pump capable of producing the other pressure, the one pressure being great enough to create a force sufficient to overcome the weight of the advancing means and thereby cause the downwardly presented surface of the advancing means to move away from the bottom surface of the chute, the other pressure creating a force less than that required to raise the advancing means whereby the force exerted on the material is reduced; and valve means between the pump means and the cylinder means for causing fluid to be directed to the cylinder means at either one of the pressures, the valve means including a first valve between the first pump and the cylinder means and having a setting which prevents the flow of fluid through it, another setting which permits high pressure fluid to flow to the cylinder means such that the cylinder means exerts an upwardly directed force on the advancing means, and still another setting which permits high pressure fluid to flow to the cylinder means such that the cylinder means exerts a downwardly directed force on the advancing means, and a second valve between the second pump and the cylinder means and having a setting which blocks the flow of fluid from the second pump to the cylinder means and another setting which permits fluid to flow from the second pump to the cylinder means such that the cylinder means exerts an upwardly directed force on the advancing means.

12. A machine according to claim 11 and further comprising a first relief valve connected between the second pump and the second valve and having a setting higher than the discharge pressure of the second pump, and a third valve shunting the first relief valve so that the first relief valve can be by-passed.

13. A machine according to claim 12 wherein the first pump is also connected to the cylinder means through the second valve to supply make-up fluid to the cylinder means when the cylinder means is descending against an upwardly directed force generated by the second pump.

* * * * *